United States Patent [19]

Gupta et al.

[11] Patent Number: 4,626,965

[45] Date of Patent: Dec. 2, 1986

[54] ILLUMINATION SYSTEM FOR A VISUAL DISPLAY TERMINAL

[76] Inventors: Vijai P. Gupta; Jyoti Gupta, both of P.O. Box 516, Berwyn, Pa. 19312

[21] Appl. No.: 800,226

[22] Filed: Nov. 21, 1985

[51] Int. Cl.[4] ..... A61G 13/00

[52] U.S. Cl. ..... 362/33; 362/98; 362/223; 362/249

[58] Field of Search ..... 362/33, 98, 86, 223, 362/249

[56] References Cited

U.S. PATENT DOCUMENTS

| | | | |
|---|---|---|---|
| 2,007,164 | 7/1935 | Horwitt | 362/86 |
| 3,079,491 | 2/1963 | Janssen | 362/86 |
| 3,675,527 | 7/1972 | Reeder, Jr. | 362/86 |
| 4,250,537 | 2/1981 | Roegner et al. | 362/86 |
| 4,414,609 | 11/1983 | Shemitz | 362/33 |
| 4,432,044 | 2/1984 | Lautzenheiser | 362/33 |
| 4,434,453 | 2/1984 | Campbell | 362/33 |
| 4,454,569 | 6/1984 | Maguire | 362/33 |

*Primary Examiner*—E. Rollins Cross

*Attorney, Agent, or Firm*—Ruth Moyerman

[57] ABSTRACT

Two embodiments for an illumination system for a keyboard. One embodiment includes a channel located longitudinally between a visual display screen and its lower keyboard. An illuminator is mounted longitudinally in the channel so that light emitted is directed only to the keyboard and the work surface, avoiding illuminating the screen. The other embodiment includes a free standing keyboard illuminator including a housing sized to span a keyboard. The housing includes two contiguous, longitudinal sections with the first front section including a light source with a diverter to shed light only on the keyboard. The second back section includes a counterbalancing weight in relationship with the first section.

5 Claims, 3 Drawing Figures

ILLUMINATION SYSTEM FOR A VISUAL DISPLAY TERMINAL

BACKGROUND OF THE INVENTION

1. Field of the Invention

This invention relates to illumination of a visual display terminal and more particularly to the illumination of the keyboard.

2. Description of the Prior Art

With advances in technology, most every office, including small business firms and even private homes, are equipped with visual display terminals including a screen and keyboard. The proper balance of room lighting, along with the absence of glare for screen readability, and adequate keyboard illumination has not been achieved through previous patents.

For example, U.S. Pat. No. 4,173,034 to Schemitz discloses a fixture with a reflector which reflects a portion of the incident light toward the ceiling and transmits a portion of the light to the area below the fixture. In Shemitz, the light is directed at the screen as well as the keyboard.

U.S. Pat. No. 4,414,609, again to Shemitz, discloses a system providing a back lighting component as well as task and ambient lighting. A visual display terminal luminaire is provided which directs a portion of the light output of the luminaire to the wall or back panel behind the display terminal. By directing the light to the back wall, Schemitz decreases the lighting contrast on the screen, thus decreasing the readability of the screen. The Shemitz patent does not decidedly increase the visability of the keyboard.

No prior art device is known in connection with visual display terminals that improves the readability of the screen at the same time it improves the illumination of the keyboard and the work surface.

SUMMARY OF THE INVENTION

The aforementioned prior art problems are obviated by the device of this invention in which two embodiments are disclosed.

The first embodiment is a combination illumination and visual display terminal. A housing includes a generally vertical visual display terminal juxtaposed above a generally horizontal keyboard extending forward and therebelow.

A longitudinal channel is located between the screen and the keyboard. The channel has a perimeter forming part of the housing. The channel also includes a longitudinal opening running its entire length with both of the opening's horizontal rims forming a plane with the terminal screen. Light means are mounted longitudinally in the channel so that light emitted from the means is thereby directed only on the keyboard, avoiding illumination of the screen.

A second embodiment is a free standing keyboard illumination with a flat topped housing sized to span a keyboard. The housing includes two contiguous sections. The first front section includes a light source and a generally open bottom to act as a light. The second rearward section is adapted to rest on a horizontal surface and is of a predetermined weight in relationship to the first section to provide its counterbalance.

A means to divert the light is associated with the housing's front section and is interfaced with the housing's open bottom.

It is therefore an object of this invention to provide a device that illuminates the keyboard and the work surface without directing light to the screen.

It is also an object of this invention to provide a device whereby conventional room lighting may be used.

It is still another object of this invention to reduce glare by preventing the light of the luminaire to reach the eyes of the operator.

It is yet another object of this invention to eliminate the need for lighting backwalls, thereby the lighting contrast between the keyboard and the screen is sharply increased making the screen more readable.

It is also another object of this invention to provide a device that does not require the visual display terminal to be placed in a cubicle or superstructure.

These and other objects will be more readily ascertainable to one skilled in the art from a consideration of the following Figures, description and exemplary embodiments.

BRIEF DESCRIPTION OF THE DRAWING(S)

DETAILED DESCRIPTION OF THE PREFERRED EMBODIMENT(S)

Figure 1:
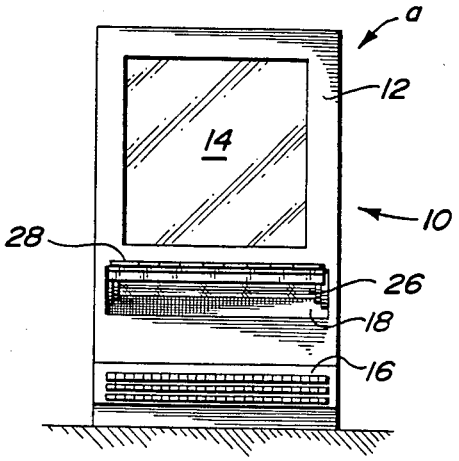
FIG. 1 is a front view of the first embodiment showing the light means mounted in the channel located longitudinally between the screen and the housing.

Referring now to the drawings and more particularly to FIG. 1, the first embodiment A of the illuminated device and visual display terminal is shown with housing 10 including visual display terminal 12 including vertical screen 14. Screen 14 is juxtaposed above generally horizontal keyboard 16.

Light 26 is mounted longitudinally in channel 18 while light diverting means 28 is mounted above light 26 so that light emitted from light 26 is thereby adjustably directed only onto keyboard 16, thereby avoiding additional illumination of screen 14.

Figure 2:
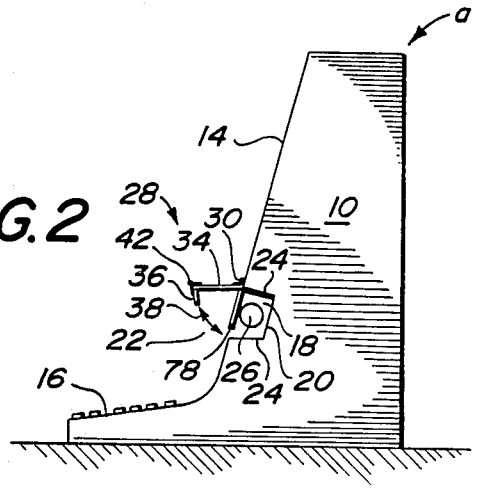
FIG. 2 is a side view of the first embodiment more clearly showing the light diverting means.

Referring now to FIG. 2, a side view of first embodiment A more clearly shows channel 18, housing light 26 and light diverting means 28 shielding light 26 from screen 14. Channel 18 is located longitudinally in housing 10 between screen 14 and keyboard 16. Perimeter 20 of channel 18 forms a part of housing 10. Channel 18 includes longitudinal opening 22 running generally the entire length of channel 18. Horizontal rims 24 form a plane with terminal screen 14.

Light 26 is mounted longitudinally in channel 18. Light diverting means 28 includes shade 34, lip 36 and corresponding friction hinges 30 and 42. Shade 34 is connected to top horizontal rim 24 of housing 10 by adjustable hinge 30. Lip 36 is connected to shade 34 by another adjustable hinge 42. Light diverting means 28 is completely adjustable and thereby provides that light emitted from light 26 may be diverted in the direction of arrow 38 so that it shines directly onto keyboard 16, avoiding additional illumination of screen 14. Lip 36 and shade 34 also prevent light 26 from reaching the operator's eyes. Optional light diffusing means, which is shown as lens 78, is attached to light diverting means 28 approximately at hinge 30, thereby diffusing and protecting light 26.

Figure 3:
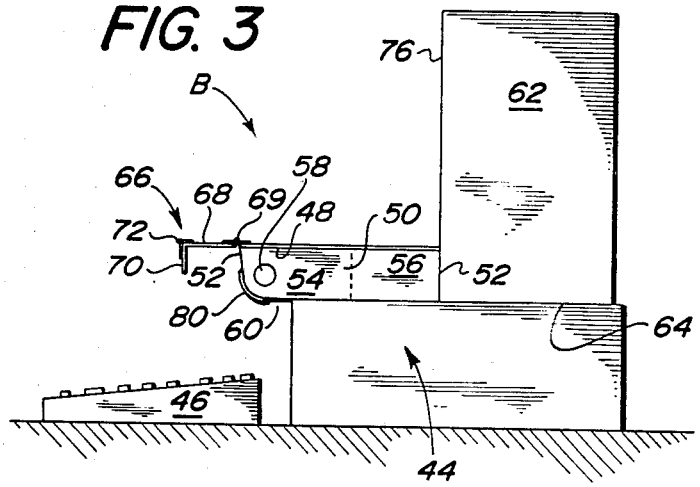
FIG. 3 is a side view of the second embodiment showing the first section containing the light source with light diverting means and the second rearward section adapted to provide a counterbalance in relationship to the first section.

Referring now to FIG. 3, a side view of second embodiment B is shown as a free standing keyboard illuminator. Generally elongated and flat topped, housing 44 is sized to span keyboard 46. Housing 44 includes ceiling 48, sides 50 (one shown) and ends 52. Housing 44 also includes two contiguous, longitudinal sections 54 and 56.

First section 54 receives light 58 and generally open bottom 60 dispenses light 58. Second rearward section 56 is adapted to rest on horizontal surface 64 of terminal 62. Section 56 is of a predetermined weight in relationship to first section 54 to provide a counterbalance therefor and to generally contain the necessary electrical parts.

Light diverting means 66 includes shade 68 with adjustable hinge 69 and lip 70 with adjustable hinge 72. Shade 68 is connected to housing 44 by adjustable hinge 69 and lip 70 is connected to shade 68 by another adjustable hinge 72. Light diverting means 66 is thereby completely adjustable and provides that rays emitted from light 58 may be diverted so that it shines directly onto keyboard 46, avoiding additional illumination of screen 76 and of the operator's eyes.

Optional light difusing means, which is shown as lens 80, covers open bottom 60 and is attached to light diverting means 66 approximately at hinge 69, thereby diffusing and protecting light 58.

There are many variations which may be practiced within the scope of this invention. For example, while a friction hinge is described, any suitable hinging means may be used and still be within the scope of the invention.

While the lip, as illustrated, is connected to the shade by an adjustable hinge, it is merely preferred. The lip could be fixed and still be within the scope of the invention.

While the shield illustrated is angular, one with a curved surface could be substituted and still be within the scope of this invention.

The division of the first light section and second weighted section in embodiment B is approximately fifty-fifty, but any suitable variance may be substituted. Also, the overall dimensions of embodiment B are not critical so long as proper balance has been maintained.

While the built-in light is illustrated in the housing between screen 14 and keyboard 16 in FIGS. 1 and 2, it could be built in the computer box housing 44 of FIG. 3 and still be within the scope of the invention.

The device of this invention has many advantages. In particular, the device illuminates only the keyboard and work surface without directing light to the screen and eyes of the user. Conventional room lighting may be used so that other tasks may be simultaneously performed. The device of the invention eliminates the need for back wall lighting or placing the terminal in a cubicle or super structure.

Having now illustrated and described my invention, it is not my intention that such description limit the invention, but that the invention be limited only by a reasonable interpretation of the appended claims.

What is claimed is:

1. A combination illumination and visual display terminal comprising:

(a) a housing including (i) a visual display terminal including a generally vertical screen juxtaposed above a generally horizontal keyboard extending forward and therebelow;

(ii) a channel located longitudinally in said housing between said screen and said keyboard, said channel having a perimeter forming part of said housing, said channel including a longitudinal opening running generally its entire length, both of said opening's horizontal rims forming a plane with said terminal screen; and, (b) light means mounted longitudinally in said channel so that light emitted from said means is thereby directed generally only on said keyboard while avoiding illuminating said screen.

2. A free standing keyboard illuminator comprising:

(a) a generally elongated and flat topped housing sized to span a keyboard, said housing including a ceiling, sides and ends and said housing including two contiguous, longitudinal sections, said first front section having means therein to receive a light source and a generally open bottom to act as a light, said second rearward section adapted to rest on a horizontal surface, said second section being of a predetermined size to house electrical parts and a predetermined weight in relationship to said first section to provide a counterbalance therefor; and, (b) light diverting means associated with and extending outward from said housing top beyond said housing's front section's interface with said housing's open bottom.

3. The device according to claim 1 comprising, additionally, a light diverting means associated with and extending outward from channel's top said horizontal rim.

4. The device according to claim 3 comprising, additionally, light diffusing means projecting downward between said light diverting means and said light means.

5. The device according to claim 2 comprising, additionally, light diffusing means projecting downward between said light diverting means and said light means.

* * * * *